United States Patent [19]

Taniguchi

[11] Patent Number: 4,850,540

[45] Date of Patent: Jul. 25, 1989

[54] STOP VALVE-CARRYING ROTARY NOZZLE FOR MACHINE TOOLS

[75] Inventor: Shoichi Taniguchi, Shiga, Japan

[73] Assignee: Nippon Thompson Company, Ltd., Tokyo, Japan

[21] Appl. No.: 165,502

[22] Filed: Mar. 8, 1988

[51] Int. Cl.[4] ..... B05B 1/30

[52] U.S. Cl. ..... 239/579; 239/581.1; 251/292; 251/352

[58] Field of Search ..... 239/DIG. 4, 581.1, 591, 239/579; 251/292, 352, 350, 339

[56] References Cited

U.S. PATENT DOCUMENTS

| | | | |
|---|---|---|---|
| 1,914,736 | 6/1933 | Coutu | 251/352 X |
| 3,380,478 | 4/1968 | Garrison | 251/352 X |
| 3,855,640 | 12/1974 | Filliung | 251/352 X |
| 4,568,027 | 2/1986 | Lazarus | 239/579 X |

FOREIGN PATENT DOCUMENTS

| | | | |
|---|---|---|---|
| 327547 | 7/1935 | Italy | 251/352 |
| 28359 | 3/1981 | Japan | 251/352 |

*Primary Examiner*—Andres Kashnikow
*Assistant Examiner*—Patrick N. Burkhart
*Attorney, Agent, or Firm*—L. Lawton Rogers, III; Joseph M. Killeen

[57] ABSTRACT

There is provided a stop valve-carrying rotary nozzle for a machine tool designed to eject a fluid onto the portion of a work which is being worked thereby improving the work-cooling and cutting efficiency of the machine tool.

The present rotary nozzle consists of a nozzle body having a throughbore and a spherical member having a throughbore that is in turn fitted within the fluid outlet side of said throughbore of the nozzle body with a sealing O-ring being interposed between the spherical member and the throughbore of the valve body, while allowing a free rotation of the spherical member on its own axis therein. Upon the spherical member having been fitted within the throughbore of the valve body, the annular edge of the valve body is inwardly bent by calking to surroundingly engage the outer half surface of the spherical member, while a portion of the thus inwardly bend annular edge is provided a recess longitudinally extending above and beyond the center of the spherical member and having a width slightly greater than the diameter of the throughbore of the spherical member so that when the rotary nozzle is to be made inoperative, a rod like plug is inserted from outside into the opening mouth of the throughbore of the spherical member and then moved together with the thus fitted spherical member until the plug is inserted between said recess.

2 Claims, 2 Drawing Sheets

STOP VALVE-CARRYING ROTARY NOZZLE FOR MACHINE TOOLS

BACKGROUND OF THE INVENTION

1. Field of the Invention

This invention relates to a rotary nozzle for a machine tool, which is used to eject a fluid onto a portion to be processed of a work mainly for the purpose of improving the work-cooling and cutting capability of the machine tool.

2. Description of the Prior Art

In general, a machine tool is provided with a plurality of rotary nozzles fixed to the circumferential portion of a tool therein (for example, ten-odd rotary nozzles on the circumferential portion of a tool), and a fluid is ejected from these nozzles at once by opening and closing a flow rate regulating valve provided at some other portion of the machine tool, to cool a work and improve the cutting efficiency.

The regulation of the flow rate and velocity of flow of the fluid passing through the rotary nozzles is carried out by another regulating valve which controls the rotary nozzles collectively, and most of the conventional rotary nozzles of this kind do not have valve means.

The conventional rotary nozzles include a rotary nozzle provided with a known flow rate regulating valve at the outlet side thereof but such a rotary nozzle is large-sized and excessively high-priced. Moreover, such a rotary nozzle is not capable of finely regulating the flow rate of a fluid. Consequently, such a rotary nozzle has application problems.

A rotary nozzle for a machine tool is originally provided with independent flow rate regulating functions in many cases. Adding a flow rate-regulating valve to such a rotary nozzle means an over-functioning rotary nozzle.

In a machine tool, the overall flow rate of a fluid applied to a portion being processed of a work under a certain processing conditions is constant, and it is necessary to regulate a maximum flying distance of the fluid by increasing and decreasing the velocity of flow thereof. To meet these requirements, it is necessary that the rotary nozzle be provided with a fluid stop valve means.

Regarding this requirement, a conventional rotary nozzle generally has no functions of regulating a maximum flying distance of a fluid. Some conventional rotary nozzle having such functions, which are provided by a flow rate regulating valve, are expensive, and have too large diamension.

SUMMARY OF THE INVENTION

An object of the present invention is to solve the above-mentioned problems.

To achieve this object, the present invention provides a stop valve-carrying rotary nozzles for machine tools, which have the following construction. (1) A stop valve-carrying rotary nozzle for a machine tool, having a spherical member provided with a through bore passing the center of the spherical member, a nozzle body provided with a through bore capable of fitting the spherical member in the inner circumferential surface of one side portion thereof, and an O-ring annularly contacting the spherical member and nozzle body when the spherical member is inserted in the through bore in the nozzle body and engaged therewith, wherein the portion of the wall of the nozzle body which defines the through bore therein is provided with a recess which extends from the end surface of the wall to a position beyond the center of the spherical member fitted in the nozzle body, and which has a width larger than the diameter of the through bore in the spherical member, the spherical member and nozzle body being fixed to each other by calking after the spherical member has been fitted in the nozzle body, the O-ring being in engagement in an elastically deformed state with the nozzle body and spherical member. (2) A stop valve-carrying rotary nozzle for a machine tool according to the invention (1), wherein a cylindrical guide tube is fitted firmly in an outer portion of the through bore in the spherical member, the outer diameter of the guide tube being set smaller than the width of the recess in the nozzle body.

The above and other objects as well as advantageous features of the invention will become apparent from the following description of the preferred embodiments taken in conjunction with the accompanying drawings.

BRIEF DESCRIPTION OF THE DRAWINGS

FIGS. 1–4 show the embodiments of the present invention, wherein:

FIG. 1 is a front elevation of a first embodiment of the rotary nozzle according to the present invention;

FIG. 2 is a side elevation of the first embodiment;

FIG. 3 is a front elevation of a second embodiment; and

FIG. 4 is a top plan of the embodiment of FIG. 3.

Figure 1:
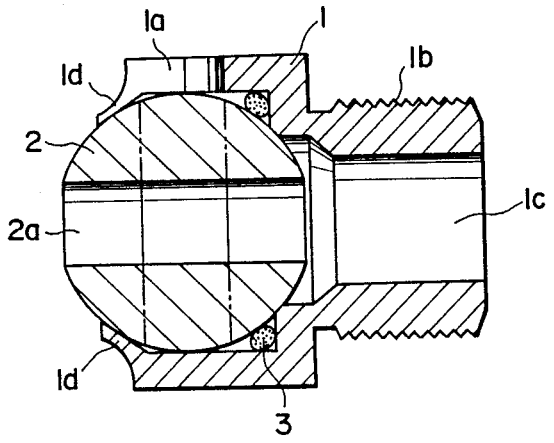

Description of the Preferred Embodiment:

FIG. 1 shows a first embodiment of the rotary nozzle for a machine tool according to the present invention.

A through bore 1*c* is formed in a nozzle body 1, axially one side portion of which has a cross-sectionally hexagonal outer circumferential surface, and the other side portion of which has a thread 1b on its outer circumferential surface formed to an outer diameter smaller than that of the hexagonal portion. The diameter of the part of the through bore 1c which is in the portion having a hexagonal outer circumferential surface is set smaller than that of the part thereof which is in the portion having the thread 1*b*.

In the through bore 1*c* in the portion of the nozzle body 1 which has a hexagonal outer circumferential surface, a spherical member 2 having a through bore 2*a* passing the center of the spherical member 2 is fitted, and the spherical member 2 contacts an O-ring 3 inserted in advance in an end surface which is formed by the larger-diameter through bore 1C and a smaller-diameter through bore 1*c* in the nozzle body 1, and which is on the side of the larger-diameter through bore 1*c*.

The spherical member 2 projects slightly from the nozzle body 1. Since the nozzle body 1 and spherical member 2 are combined firmly by calking one end surface of the tapered thin-wall part of the former, the rotary nozzle can be manufactured at a low cost.

A plurality of rotary nozzles are fixed to predetermined portions of a machine tool by utilizing the thread 1*b* on the nozzle body 1 of each thereof. A fluid is sent into the through bore 1*c* into the portion of the nozzle body which has the thread 1*b*, and ejected from the through bore 2*a* in the spherical member 2. The leakage of the fluid from the nozzle body 1 is prevented by the O-ring 3 contacting two parts, i.e., the nozzle body 1 and spherical member 2.

Therefore, if the quantity of the axial displacement of the calked nozzle body 1 and spherical member 2 is not larger than that of the elastic deformation of the O-ring, the sealing effect of the O-ring can be displayed. Accordingly, the accuracy of the calking of the nozzle body 1 can be low, and the rotary nozzle can be manufactured at a low cost.

A recess 1*a* is formed at one portion of the nozzle body 1 so as to extend in the axial direction thereof from a calked portion 1*d* to the hexagonal ouer circumferential surface of the nozzle body 1. In order to move the through bore 2*a* in the spherical member 2 to a substantially vertical position shown by two-dot chain lines, for stopping the fluid passing through the rotary nozzle, a rod type member is inserted into the through bore 2*a* in the spherical member 2 and then moved so as to be fitted in the recess 1*a* in the nozzle body 1. Consequently, the through bore 2*a* in the spherical member 2 is moved from a position closer to the O-ring 3 to a position on the side of the calked portion 1*d*, so that the ejection of the fluid can be interrupted.

When it is necessary to increase the velocity of flow of the fluid in the rotary nozzles having the above-mentioned functions and fixed to a machine tool, a thinned-out operation of the rotary nozzles may be carried out, i.e., the ejection of the fluid from a suitable number of rotary nozzles may be interrupted.

Figure 2:
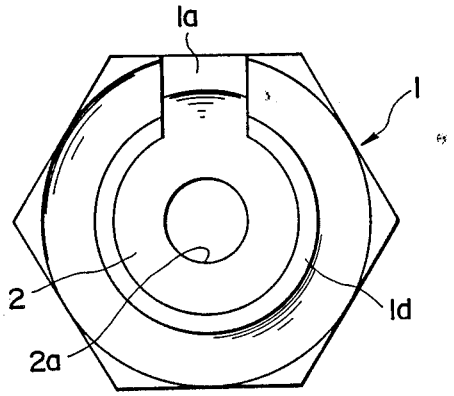

FIG. 2 is a side elevation of what is shown in FIG. 1. The recess 1a with a circular ballon in the nozzle body 1 is made by using an end mill before the spherical member 2 has been inserted in the nozzle body 1.

Figure 3:
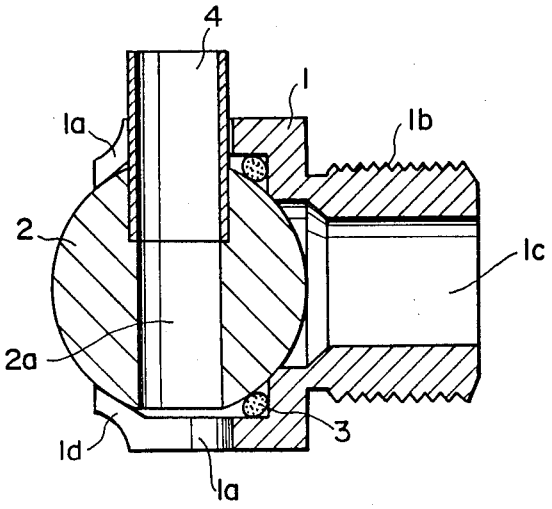

FIG. 3 is a front elevation of a second embodiment of the present invention. This drawing shows the embodiment with a flow of a fluid stopped. A through bore 2*a* in the spherical member 2 is provided with a stepped portion, and a cylindrical guide tube 4 is press fitted in a larger-diameter portion of this stepped through bore 2*a*.

The embodiment shown in the drawing has two recesses 1*a* at the upper and lower portions of the nozzle body 1. Such recesses can be formed at not less than three portions of the nozzle body 1 as necessary.

In the second embodiment, the passage of the fluid can be stopped by inserting the guide tube 4 from the recess 1*a* in the nozzle body 1. Accordingly, the operation efficiency can be improved, and an excellent directional stability of the fluid being ejected through the guide tube 4 can be obtained.

Figure 4:
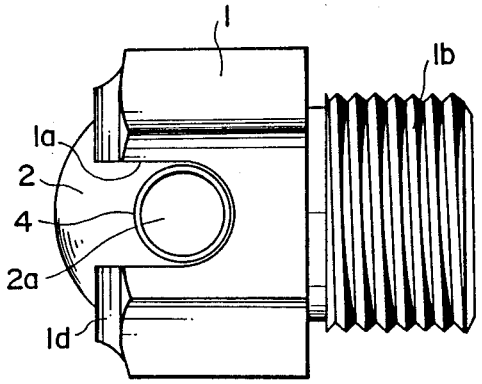

FIG. 4 is a top plan of what is shown in FIG. 3. The depth of the recess 1*a* may be set to a level which allows the axis of the guide tube 4 engaged with the recess 1*a* to extend at substantially right angle to the axis of the through bore 1*c* in the nozzle body 1.

The guide tube 4 may be set firmly in the spherical member 2 by not only the press fitting but also various other kinds of methods, such as screwing and welding.

The present invention has the following benefits.

(1) In the case where a plurality of rotary nozzles are fixed to the portion of a machine tool which is in the vicinity of a processing portion thereof, the overall velocity of flow of the fluid can be regulated.

(2) The stopping and ejecting of the fluid can be done easily.

(3) The rotary nozzle can be manufactured at a low cost.

(4) A light, miniaturized rotary nozzle can be obtained.

The present invention is not, of course, limited to the above embodiments; it may be modified in various ways within the scope of the appended claims.

What is claimed is:

1. A stop valve-carrying rotary nozzle for a machine tool, having a spherical member provided with a cylindrical through bore passing through the center thereof, a nozzle body provided with a through bore capable of fitting said spherical member whtin the inner circumferential surface of one side portion thereof, wherein the portion of the wall of said nozzle body which defines said through bore therein is provided with a recess which extends from the end surface of said wall to a position beyond the center of said spherical member fitted in said nozzle body, and which recess has a width larger than the diameter of said through bore in said spherical member, said spherical member and said nozzle body being fixed to each other by caulking after said spherical member has been fitted in said nozzle body, said through bore of said nozzle body forming in a rearward portion thereof a substantially triangular-shaped in cross-section annular space concentric with the axis of said through bore defined by the exterior surface of said spherical member and the inner circumferential surface of the wall of said nozzle body at a position beyond the center of said spherical member, and an O-ring seated in said annular space being in engagement in an elastically deformed state with the inner circumferential surface of the wall of said nozzle body and said spherical member, when said spherical member is inserted in said through bore in said nozzle body and engaged therewith.

2. A stop valve-carrying rotary nozzle for a machine tool according to claim 1, wherein a cylindrical guide tube is fitted firmly in an outer portion of said through bore in said spherical member, the outer diameter of said guide tube being set smaller than the width of said recess in said nozzle body.

* * * * *